US006988292B1

(12) United States Patent
Wang et al.

(10) Patent No.: US 6,988,292 B1
(45) Date of Patent: Jan. 24, 2006

(54) FLEXIBLE BRUSH COMPRISING A MIXTURE OF POLYMERS

(75) Inventors: Ping Wang, Guangzhou (CN); John Geoffrey Chan, Guangzhou (CN); XiaoDan Xu, Guangzhou (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/110,913

(22) PCT Filed: Oct. 20, 1999

(86) PCT No.: PCT/US99/24813

§ 371 (c)(1),
(2), (4) Date: Apr. 17, 2002

(87) PCT Pub. No.: WO01/29128

PCT Pub. Date: Apr. 26, 2001

(51) Int. Cl.
*A46B 9/04* (2006.01)
*A46B 5/00* (2006.01)

(52) U.S. Cl. ..... 15/167.1; 15/143.1; 15/159.1; 16/110.1

(58) Field of Classification Search ..... 15/167.1, 15/159.1, 143.1; 16/110.1
See application file for complete search history.

(56) References Cited

U.S. PATENT DOCUMENTS

| | | | | |
|---|---|---|---|---|
| 5,052,071 A | * | 10/1991 | Halm | 15/167.1 |
| 5,735,012 A | * | 4/1998 | Heinzelman et al. | 15/167.1 |
| 5,815,874 A | | 10/1998 | Weihrauch | |

FOREIGN PATENT DOCUMENTS

| | | |
|---|---|---|
| EP | 0 324 278 | 7/1989 |
| EP | 0 757 077 | 2/1997 |
| FR | 2 730 242 | 8/1996 |
| JP | 9-19323 | 1/1997 |
| WO | WO 92/17092 | 10/1992 |
| WO | WO 92/17093 | 10/1992 |

OTHER PUBLICATIONS

Non–final Office Action for U.S. Appl. No. 10/659,489 dated Dec. 28, 2004.

* cited by examiner

*Primary Examiner*—Gary K. Graham
(74) *Attorney, Agent, or Firm*—James C. Vago; Karen F. Clark

(57) ABSTRACT

Disclosed is a brush having a one-piece body comprised of a handle and at one end thereof a head provided with bristles, wherein the brush body comprises a mixture of first polymer and a second polymer that is of a lesser hardness than the first polymer, wherein the ratio of the first polymer to the second polymer is from about 95:5 to about 30:70.

18 Claims, 3 Drawing Sheets

FLEXIBLE BRUSH COMPRISING A MIXTURE OF POLYMERS

FIELD

The present invention relates to a brush with improved flexibility. More specifically, it relates to a flexible brush comprising a mixture of polymers, in particular a toothbrush with a flexible neck area.

BACKGROUND

Brushes that are in use today, and in particular toothbrushes, are commonly made entirely from plastic materials. The bristles of the brush generally comprise a high-grade polyamide, processed by extrusion to form thin fibers, which are then stretched and thermally stabilized. The body of the brush, however, is typically made from a lesser grade plastic that is injection molded. The head area of the brush body must be so dimensioned as a function of the nature of the fixing of the bristles, that the latter, which are optionally combined in bundles, are adequately firmly anchored.

For toothbrushes, the head area must also be as flat as possible so as to take up as little space in the oral cavity as possible, or so as to be able to utilize the existing space with substantially extended bristles. The handle of the body must be dimensionally stable and rigid. It is also desirable for the head to be somewhat flexible with respect to the handle in order to damp the pressing force during the cleaning of the teeth, or to otherwise control the pressure. Therefore, a smaller cross-section neck, which gives the brush body a certain flexibility, is generally provided between the head and the handle. The constriction resulting from the neck also fulfills an ergonomic function, in order to be able to guide the toothbrush in the desired cleaning movements with the mouth closed.

The thermoplastics generally used for toothbrushes only very inadequately fulfill these opposing requirements. This more particularly applies for the desired flexibility between the head and the handle and also the desired small cross-section at the head and neck. Therefore, the cross-section in the area of the head and neck must be relatively large, so as not to break during use or any other extraordinary stressing. The same applies with respect to the head, because the latter is cross-sectionally weakened due to the fastening measures for the bristle bundles, particularly if as is normally the case, the bundles are mechanically or thermally anchored or injected into holes in the head. Also when welding the bundles onto the head material, weakening may occur, because the surface molecular structure on the head may be disadvantageously modified.

Although many toothbrushes on the market today claim to have flexible neck designs, in fact most of these brushes are not truly flexible. Some merely use a twisted neck pattern or a narrow neck design to create a visual impression of flexibility.

In addition, previous attempts to achieve a desired flexibility in the head with respect to the handle, or in the head alone, have involved multi-component brushes, which have inserted springs or distinct thermoplastic elastomer sections inserted in the neck area between the head and the handle. See, e.g., Japanese Kokai application H9-19323 to Shiseido, published on Jan. 21, 1997; and International Publication Nos. WO 92/17092-3, published Oct. 15, 1992. Such brushes have limited flexibility, since they can only bend at the hinge areas or according to the distribution of the separate elastomer sections. In addition, they may require greater attention to manufacturing tolerances and may be more expensive to manufacture than a one piece brush.

Yet another proposed solution is to provide a brush body made of an elastomer mixed with a foaming agent in the area of the handle, and being substantially solid in the area of the smaller cross-section of the head. See U.S. Pat. No. 5,815,874 to Weihrauch on Oct. 6, 1998.

However, there remains a desire to provide a cost-effective, one-piece brush that has a true, multi-directional bending capability. None of the existing art provides all of the advantages and benefits of the present invention.

SUMMARY

The present invention relates to a brush having a one-piece body comprised of a handle and at one end thereof a head provided with bristles, wherein the brush body comprises a mixture of first polymer and a second polymer that is of a lesser hardness than the first polymer, wherein the ratio of the first polymer to the second polymer is from about 95:5 to about 30:70.

These and other features, aspects, and advantages of the invention will become evident to those skilled in the art from a reading of the present disclosure.

BRIEF DESCRIPTION OF THE DRAWINGS

While the specification concludes with claims particularly pointing out and distinctly claiming the invention, it is believed that the present invention will be better understood from the following description of preferred embodiments taken in conjunction with the accompanying drawings in which:

DETAILED DESCRIPTION

Figure 1A:
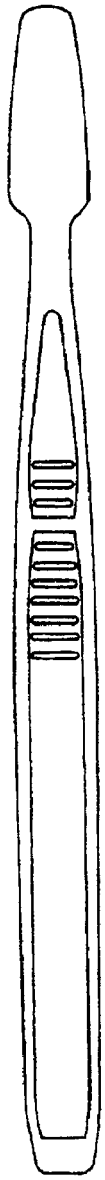
FIGS. 1*a*-3*c* are front, side, and rear views of exemplary preferred embodiments of toothbrushes of the present invention, with FIG. 1*d* illustrating a view in the direction of the arrow "A" shown in FIG. 1*c*.
Figure 1B:
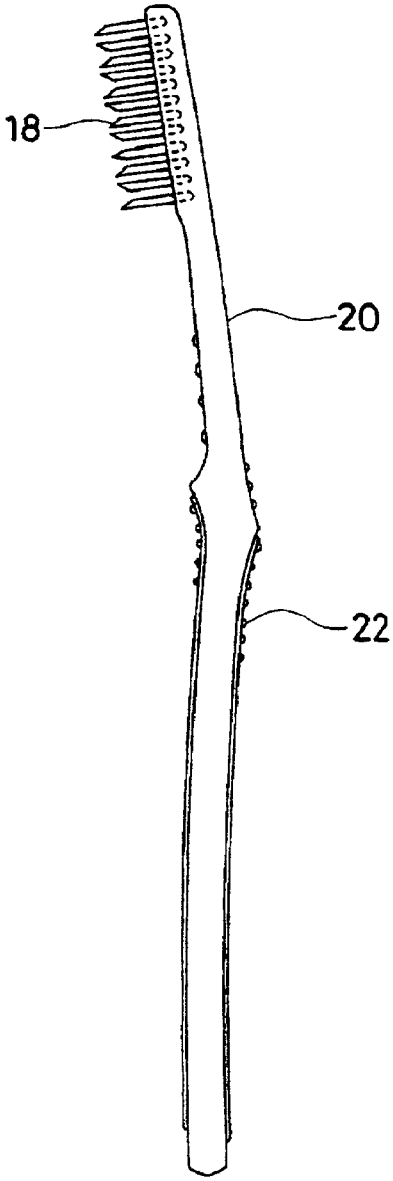
Figure 1C:
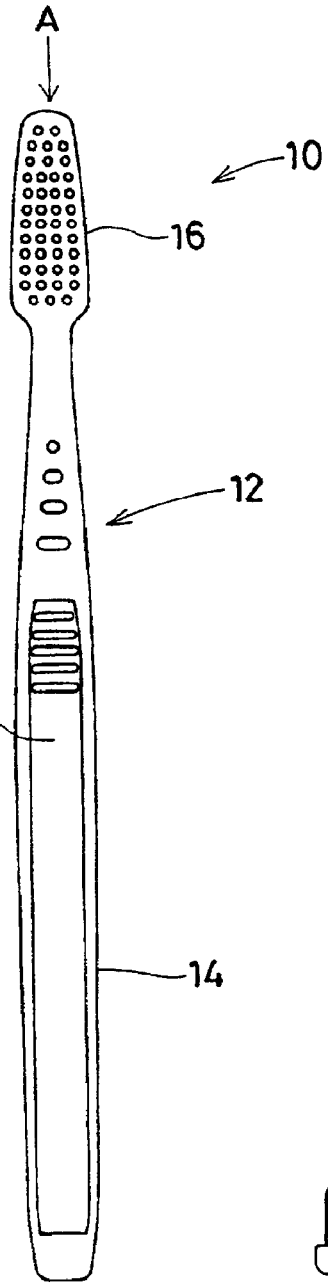
Figure 1D:
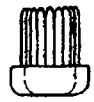

The brushes according to the present invention have a one-piece body comprised of a handle that has at one end thereof a head provided with bristles. The body is comprised of a mixture of polymers. In general, the polymer mixture is a blend of a first polymer with a second polymer that has a lower flexural modulus, i.e., that is generally more flexible, than the first polymer. More specifically, the hardness of the second polymer is less than that of the first polymer. The Shore A hardness of the second polymer is preferably from about 25 to about 85.

Preferably, the ratio of the first polymer to the second polymer is from about 95:5 to about 30:70. It is believed that this ratio is dependent on the hardness of the second polymer material. For example, for the following Shore A hardness ranges of the second polymer, the corresponding ratios of the first polymer to the second polymer are preferred herein.

For Shore A hardness of about 25 to about 45: the preferred ratio of the first polymer to the second polymer is from about 90:10 to about 60:35, with from about 85:15 to about 65:35 being more preferred.

For Shore A hardness of about 45 to about 65: the preferred ratio of the first polymer to the second polymer is from about 80:20 to about 50:50, with from about 75:25 to about 55:45 being more preferred.

For Shore A hardness of about 65 to about 85: the preferred ratio of the first polymer to the second polymer is from about 70:30 to about 40:60, with from about 65:35 to about 45:55 being more preferred.

In the following description of the preferred polymer materials for use herein, the abbreviations that are commonly used by those of skill in the art to refer to certain polymers appear in parentheses following the full names of the polymers.

The first polymer is preferably polypropylene ("PP"), or may be selected from the group consisting of other conventional toothbrush handle materials, such as polystyrene ("PS"), polyethylene (PE"), acrylonitrile-styrene copolymer ("SAN"), and cellulose acetate propionate ("CAP").

The second polymer is preferably a thermoplastic elastomer ("TPE"), a thermoplastic olefin ("TPO"), a soft thermoplastic polyolefin (e.g., polybutylene), or may be selected from other elastomeric materials, such as ethylene-vinylacetate copolymer ("EVA"), and ethylene propylene rubber ("EPR").

Examples of suitable thermoplastic elastomers herein include styrene-ethylene-butadiene-styrene ("SEBS"), styrene-butadiene-styrene ("SBS"), and styrene-isoprene-styrene ("SIS").

Examples of suitable thermoplastic olefins herein include polybutylene ("PB") and polyethylene ("PE").

In addition, color can be provided to give the brush an aesthetically pleasing appearance. Opaque or translucent colors can be provided; for translucent brushes an insert can further be provided in the handle. Such inserts can be any color and are typically made from a polypropylene material.

Techniques known to those of skill in the art, such as injection molding, can be used to manufacture the brush of the present invention. Any design, shape, or configuration for the handle and/or the bristles is suitable herein. In addition, it should be understood that while the brushes according to the present invention are particularly useful for toothbrushes for oral hygiene use, such brushes can be equally advantageously useful for cosmetic use, e.g., for hairbrushes or make-up application brushes, for use in pet care, e.g., as pet grooming brushes, as well as for household uses such as cleaning, etc. Thus, it should be understood that the present invention is not intended to be limited to toothbrushes.

For toothbrushes, the handle and the head are commonly joined via a neck area, which as noted above may be of a smaller cross-sectional area than the handle or the head. The head is provided with holes for receiving bristles or bundles of bristles, which are mechanically or thermally fixed therein, as is known to those of skill in the art. Any such method for fixing the bristles can be used herein.

The formation of the brush body, i.e, head, neck and handle, as a one-piece mixture of polymer materials according to the present invention provides the advantage of true, multi-directional flexibility. In other words, the head portion of the brush of the present invention can be bent in any direction with respect to the handle portion of the brush with equal ease. This is in contrast to the conventional brushes, in which the head has only a uni-directional flexing is capability with respect to the handle.

The flexible neck can also act to buffer excess force on the teeth and gums that may be exerted by a user.

Figure 2A:
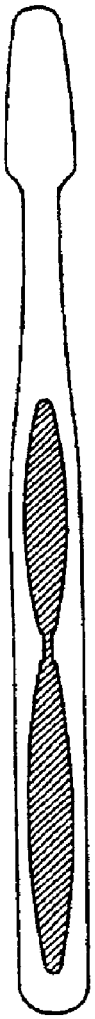
Figure 2B:
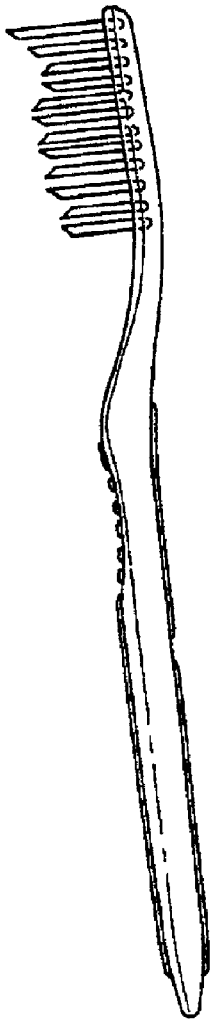
Figure 2C:
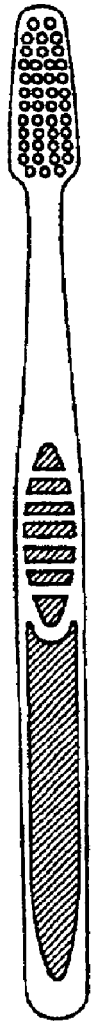
Figure 3A:
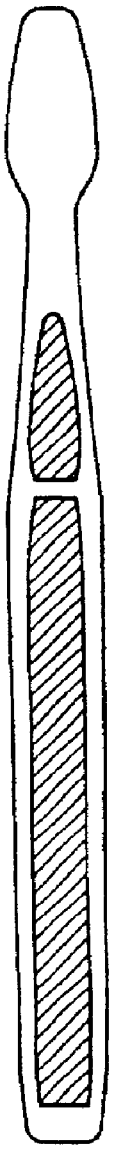
Figure 3B:
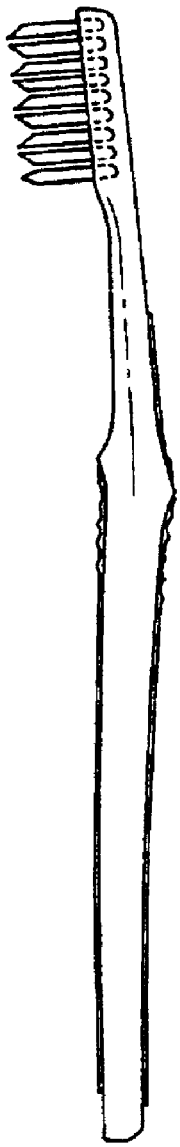
Figure 3C:
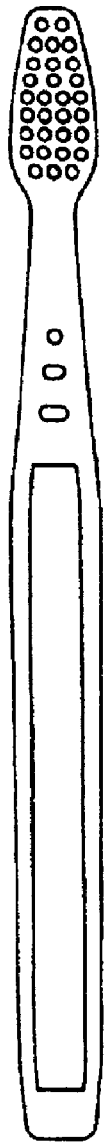

FIGS. 1–3 illustrate exemplary preferred embodiments of toothbrushes according to the present invention. FIGS. 1*a*, 2*a*, and 3*a* illustrate rear views of the respective brushes; FIGS. 1*b*, 2*b*, and 3*b* illustrate side views of the respective brushes; and FIGS. 1*c*, 2*c*, and 3*c* illustrate front views of the respective brushes. FIG. 1*d* is a view in the direction of the arrow "A" shown in FIG. 1*c*.

Referring to FIG. 1, the brush 10 has a one-piece body 12 comprised of a handle 14, and a head 16, which is provided with bristles 18. The neck 20 is located between the handle 14 and the head 16. The handle may also be provided with a non-slip grip area(s) 22 made from any suitable material known in the art including santoprene. As noted above, the bristles 18 may be provided in any configuration, including configurations having three-dimensional profiles as are known to those of skill in the art and of which non-limiting examples are shown in the figures herein, especially FIG. 1*d*. Note that although the reference numerals for FIGS. 2 and 3 are analogous to those shown in FIG. 1, they have not been repeated in FIGS. 2 and 3.

EXAMPLES

In order to illustrate the benefits of the preferred embodiments of the present invention, the flexibility of a toothbrush according to the present invention is compared to a number of different commercially available toothbrushes.

TABLE 1

Toothbrush Neck Flexibility (Newtons)

| Toothbrush name | Sample 1 | Sample 2 | Sample 3 | Sample 4 | Sample 5 | Average |
|---|---|---|---|---|---|---|
| Toothbrush of the Present Invention | 11.0 | 11.6 | 10.8 | 11.4 | 11.0 | 11.16 |
| CREST TERRACE *1 | 17.1 | 17.5 | 17.3 | 17.8 | 17.4 | 17.42 |
| COLGATE Zigzag *2 | 12.3 | 12.9 | 12.8 | 12.7 | 12.8 | 12.7 |
| COLGATE Total *2 | 12.7 | 12.4 | 12:3 | 12.1 | 12.0 | 12.3 |
| SANXIAO Unbreakable *2 | 18.6 | 19.0 | 18.7 | 18.9 | 19.2 | 18.88 |
| SANXIAO Flexible *2 | 13.5 | 14.1 | 14.2 | 13.9 | 13.3 | 13.8 |

*1 CREST TERRACE is a commercially available toothbrush from the Procter & Gamble (China) Ltd. Company, 1 Bin He Road Guangzhou Economic & Technological Development District, Guangzhou P.R.C.
*2 The brushes indicated as COLGATE Zigzag, COLGATE Total, SANXAIO Unbreakable, and SANXIAO Flexible are commercially available in at least China.

The sample brushes are tested following the test method CHN-HC-009. This method is described in detail as follows. The test apparatus comprises a tensile tester (<100 N), steel wire, and brush handle clamper.

The test samples are prepared by marking the samples with two marks: (a) for adult toothbrushes, the first mark is made at 15 mm from the top of the brush head and the second mark is made at 80 mm from the top of the brush head; (b) for children's toothbrushes, the first mark is made at 10 mm from the top of the brush head and the second mark is made at 65 mm from the top of the brush head; and (c) for babies' toothbrushes, the first mark is made at 10 mm from the top of the brush head and the second mark is made at 50 mm from the top of the brush head. The samples are prepared at a temperature of 20+5° C., and this temperature is kept constant for four hours prior to start of the testing procedure.

The test procedure is described as follows. Fold a steel wire having a diameter of about 2 mm and a length of about 250 mm and put it into the upper clamper of the tester. The brush handle is put into the brush handle gripper and is fixed on the position of the second mark (with the brush bristles downwards); the brush handle gripper is connected to the lower clamper of the tester and the steel wire is put on the position of the first mark. The tester is started up and the reading is taken when the sample is bent to 25 mm or broken. The result is measured in Newtons (N).

The testing conditions are ambient temperature maintained at 20+5° C. The rising up and dropping down speed of the tester is kept constant at 100+10 mm/min. In addition, the tensile tester must be calibrated using confirmed standard sample, or equipment manufacturer's calibration procedure.

As shown in Table 1, the degree of flexibility of a sample is indicated in that a flexible sample is more easily deformed as compared to a relatively more rigid sample, i.e., the lower the amount of force needed to bend or break a brush, the more flexible the brush is. Therefore, lower values of N indicate greater flexibility. It can further be seen from Table 1 that the sample toothbrush of the present insertion is the most flexible therein.

Thus, the preferred embodiments disclosed herein provide the advantages of greater, truer flexibility without the need to insert separate elastomeric sections. The preferred embodiments herein are also cost effective and easy to manufacture, and can be used for any brush and/or bristle configuration.

All cited references are incorporated herein by reference in their entireties. Citation of any reference is not an admission regarding any determination as to its availability as prior art to the claimed invention.

Herein, "comprising" means that other steps and other components which do not affect the end result can be added. This term encompasses the terms "consisting of" and "consisting essentially of."

All percentages and ratios used hereinafter are by weight of total composition, unless otherwise indicated.

All percentage, ratios, and levels of ingredients referred to herein are based on the actual amount of the ingredient, and do not include solvents, fillers, or other materials with which the ingredient may be combined as a commercially available product, unless otherwise indicated.

It is understood that the examples and embodiments described herein are for illustrative purposes only and that various modifications or changes in light thereof will be suggested to one of skill in the art without departing from the scope of the present invention.

What is claimed is:

1. A toothbrush, comprising:

a handle;

a head;

a neck disposed between said handle and said head;

wherein said neck comprises a mixture of a first polymer and a second polymer, wherein the ratio of said first polymer to said second polymer is between about 90:10 and about 60:35 and said second polymer has a Shore A hardness between about 25 and about 45.

2. The toothbrush according to claim 1, wherein the first polymer is selected from the group consisting of polypropylene, polystyrene, polyethylene, acrylonitrile-styrene copolymer, and cellulose acetate propionate.

3. The toothbrush according to claim 2, wherein the second polymer is selected from the group consisting of thermoplastic elastomers, thermoplastic olefins, soft thermoplastic polyolefins, ethylene-vinylacetate copolymer, and ethylene propylene rubber.

4. The toothbrush according to claim 3, wherein the thermoplastic elastomer is selected from the group consisting of styrene-ethylene-butadiene-styrene, styrene-butadiene-styrene, and styrene-isoprene-styrene.

5. The toothbrush according to claim 1, wherein the flexibility of the neck is less than about 12 Newtons, as measured according to CHN-HC-009.

6. The toothbrush according to claim 1, wherein said head further comprises said mixture of said first and second polymers.

7. A toothbrush comprising:

a handle;

a head;

a neck disposed between said handle and said head;

wherein said neck comprises a mixture of a first polymer and a second polymer, wherein the ratio of said first polymer to said second polymer is between about 80:20 and about 50:50 and said second polymer has a Shore A hardness between about 45 and about 65.

8. The toothbrush according to claim 7, wherein the first polymer is selected from the group consisting of polypropylene, polystyrene, polyethylene, acrylonitrile-styrene copolymer, and cellulose acetate propionate.

9. The toothbrush according to claim 8, wherein the second polymer is selected from the group consisting of thermoplastic elastomers, thermoplastic olefins, soft thermoplastic polyolefins, ethylene-vinylacetate copolymer, and ethylene propylene rubber.

10. The toothbrush according to claim 9, wherein the thermoplastic elastomer is selected from the group consisting of styrene-ethylene-butadiene-styrene, styrene-butadiene-styrene, and styrene-isoprene-styrene.

11. The toothbrush according to claim 7, wherein the flexibility of the neck is less than about 12 Newtons, as measured according to CHN-HC-009.

12. The toothbrush according to claim 7, wherein said head further comprises said mixture of said first and second polymers.

13. A toothbrush, comprising:

a handle;

a head;

a neck disposed between said handle and said head;

wherein said neck comprises a mixture of a first polymer and a second polymer, wherein the ratio of said first polymer to said second polymer is between about 70:30 and about 40:60 and said second polymer has a Shore A hardness between about 65 and about 85.

14. The toothbrush according to claim 13, wherein the first polymer is selected from the group consisting of polypropylene, polystyrene, polyethylene, acrylonitrile-styrene copolymer, and cellulose acetate propionate.

15. The toothbrush according to claim 14, wherein the second polymer is selected from the group consisting of thermoplastic elastomers, thermoplastic olefins, soft thermoplastic polyolefins, ethylene-vinylacetate copolymer, and ethylene propylene rubber.

16. The toothbrush according to claim 15, wherein the thermoplastic elastomer is selected from the group consisting of styrene-ethylene-butadiene-styrene, styrene-butadiene-styrene, and styrene-isoprene-styrene.

17. The toothbrush according to claim 13, wherein the flexibility of the neck is less than about 12 Newtons, as measured according to CHN-HC-009.

18. The toothbrush according to claim 13, wherein said head further comprises said mixture of said first and second polymers.

* * * * *